US006722713B2

(12) United States Patent
Straka, Jr.

(10) Patent No.: US 6,722,713 B2
(45) Date of Patent: Apr. 20, 2004

(54) REVERSE ACTUATED SLIDE LATCH

(75) Inventor: Robert L. Straka, Jr., Phoenixville, PA (US)

(73) Assignee: Southco, Inc., Concordville, PA (US)

( * ) Notice: Subject to any disclaimer, the term of this patent is extended or adjusted under 35 U.S.C. 154(b) by 0 days.

(21) Appl. No.: 10/170,257

(22) Filed: Jun. 12, 2002

(65) Prior Publication Data

US 2002/0185871 A1 Dec. 12, 2002

Related U.S. Application Data

(60) Provisional application No. 60/297,966, filed on Jun. 12, 2001.

(51) Int. Cl.[7] ..... E05C 1/10

(52) U.S. Cl. ..... 292/175; 292/DIG. 31

(58) Field of Search ..... 292/170, 175, 292/DIG. 31, 67, 114, 120, 128

(56) References Cited

U.S. PATENT DOCUMENTS

| | | | | | |
|---|---|---|---|---|---|
| 2,587,695 | A | * | 3/1952 | Citso | 292/175 |
| 2,609,222 | A | * | 9/1952 | Severson | 292/175 |
| 4,501,378 | A | * | 2/1985 | Berfield | 220/324 |
| 4,927,194 | A | * | 5/1990 | Wagner | 292/128 |
| 5,127,685 | A | * | 7/1992 | Dallaire | 292/175 |
| 5,785,398 | A | * | 7/1998 | Park | 312/223.2 |
| D399,121 | S | | 10/1998 | Alyanakian et al. | |
| 5,878,608 | A | | 3/1999 | Alyanakian | |
| 5,897,147 | A | | 4/1999 | Alyanakian et al. | |
| D409,473 | S | | 5/1999 | Tieu | |
| 5,934,716 | A | * | 8/1999 | Koveal | 292/175 |
| 5,974,842 | A | | 11/1999 | Schlack et al. | |
| D419,053 | S | | 1/2000 | Schlack | |
| 6,050,618 | A | | 4/2000 | Tieu | |
| D453,468 | S | | 2/2002 | Ziemer et al. | |

OTHER PUBLICATIONS

Photographs of a load–floor latch used in the Saturn Vue automobile (5 sheets).

Southco Handbook 2000, English edition, ISO 9001, 1999, pp. 110 and 111.

* cited by examiner

*Primary Examiner*—Gary Estremsky
(74) *Attorney, Agent, or Firm*—Paul & Paul

(57) ABSTRACT

A slide latch is disclosed that slides between an open position and a closed position to releasably secure a panel in the closed position. The slide latch is moved toward the nearest edge of the panel in order to move the latch to the open position.

9 Claims, 5 Drawing Sheets

REVERSE ACTUATED SLIDE LATCH

CROSS-REFERENCE TO RELATED APPLICATIONS

This application claims the benefit of the priority of U.S. Provisional Application No. 60/297,966, filed on Jun. 12, 2001.

BACKGROUND OF THE INVENTION

1. Field of the Invention

The present invention relates to a latching device for releasably securing a closure member, such as a panel or door, in the closed position.

2. Description of the Prior Art

Various types of latching devices for use in securing a first member such as a door, panel or the like in a closed position relative to a corresponding second member such as a door, panel or frame are known.

Some types are termed "slide latches" in that such latches have a body that is slidably supported in a first member such as a door and are biased to engage a second member such as a doorframe when the door is in the closed position. These slide latches are then moved slidably to disengage the latch from the doorframe and allow opening of the door. Examples of such slide latches are disclosed in U.S. Pat. No. 3,841,674, issued to Robert H. Bisbing et al. on Oct. 15, 1974, U.S. Pat. No. 3,850,464, issued to Robert H. Bisbing et al. on Nov. 26, 1974, U.S. Pat. No. 5,628,534, issued to Janerio N. Morgan on May 13, 1997, and U.S. Pat. No. 6,050,618, issued to Loc B. Tieu on Apr. 18, 2000.

SUMMARY OF THE INVENTION

The present invention is directed to a latch for use with closure members such as panels, drawers, doors, etc. The latch of the present invention releasably secures a first closure member, such as a door, doorframe, window, panel, or drawer, to a second closure member, such as another door, window, panel, or drawer or a frame surrounding the first closure member. The latch of the present invention includes a latch body and a torsion spring. The latch body has a first cavity which acts as a handle to allow a user to manipulate the latch and to grasp and move the closure member to which the latch is mounted. The latch body also has a second cavity that houses the torsion spring. The first cavity extends obliquely under an over-hanging edge thus providing a grasping surface for the user's fingers.

The latch body is installed in an aperture in the closure member and is adapted for sliding movement within the aperture. The latch body also has an integral pawl portion which catches the second closure member to secure the first closure member to the second closure member when the latch body is in the closed position. The torsion spring has a pair of arms, one of which presses against the latch body and one of which presses against a side of the aperture within which the latch body is installed. The torsion spring acts to bias the latch body toward the closed position. A beveled surface, provided as part of the pawl portion, cooperates with the second closure member to slide the latch body to the open position as the first closure member is slammed shut. The torsion spring then moves the latch body to the closed position once the second closure member is in registry with the gap between the pawl portion and the bottom surface of the first closure member.

DETAILED DESCRIPTION OF THE PREFERRED EMBODIMENTS

Figure 1:
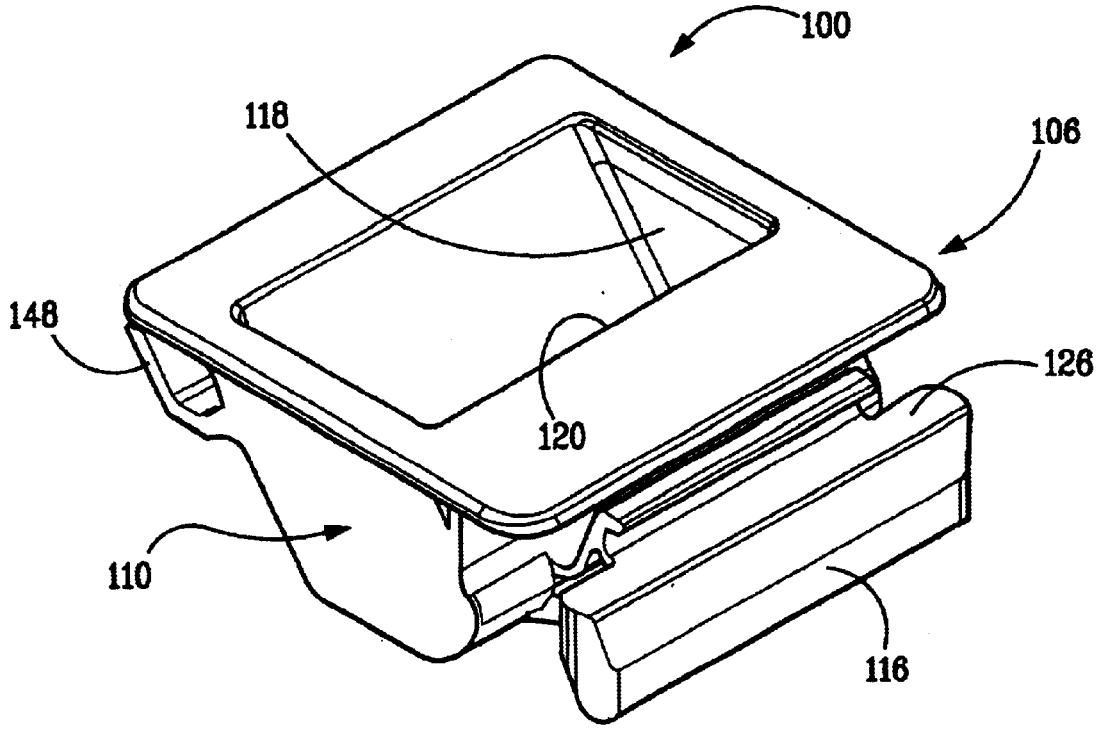
FIG. 1 is a perspective view of the slide latch of the present invention.
Figure 2:
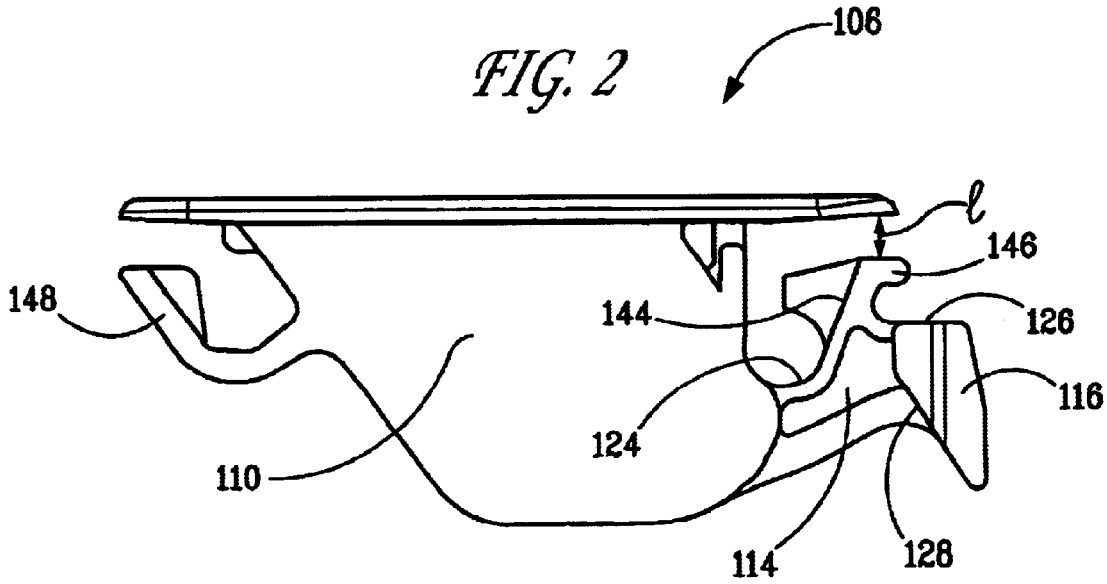
FIG. 2 is a right side elevational view of the slide latch body according to the present invention.
Figure 3:
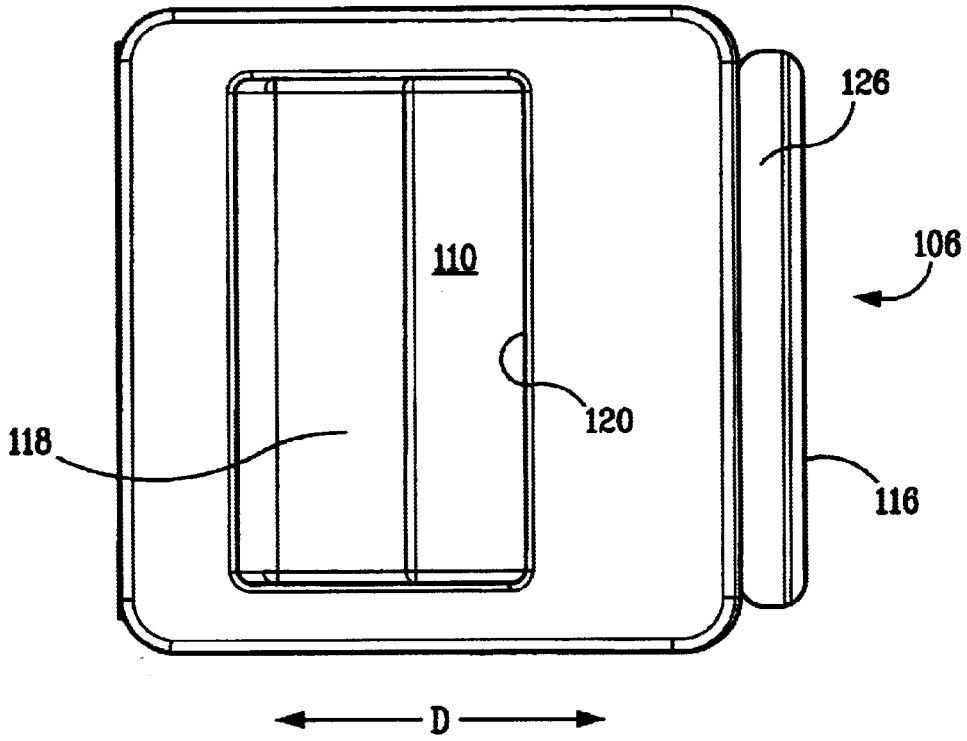
FIG. 3 is a top plan view of the slide latch body according to the present invention.
Figure 4:
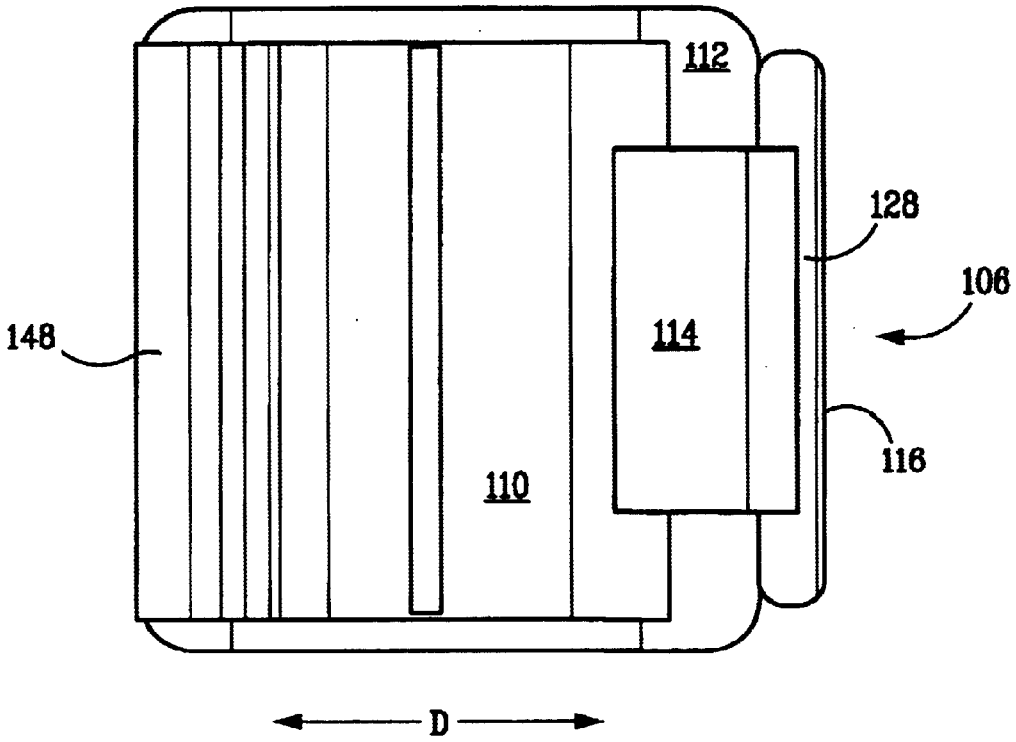
FIG. 4 is a bottom plan view of the slide latch body according to the present invention.
Figure 5:
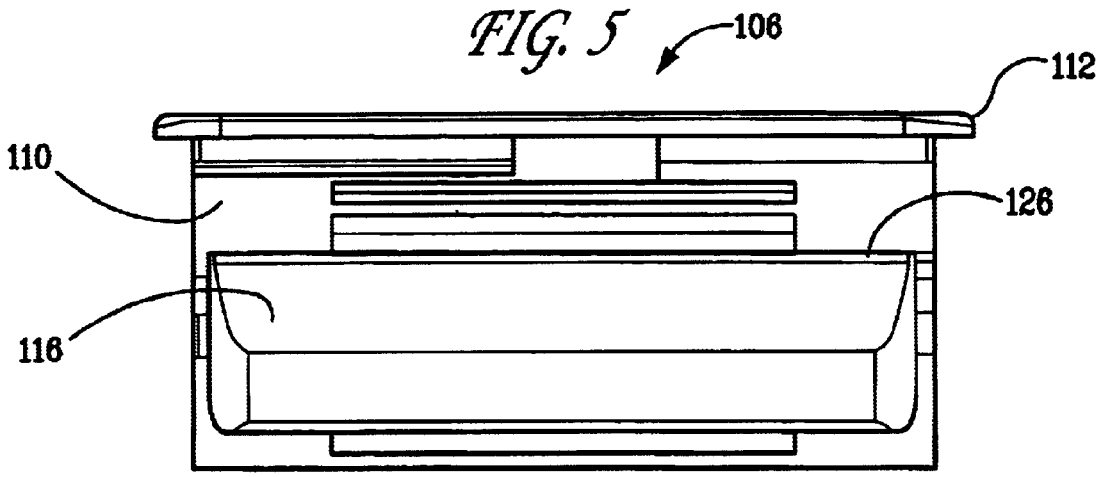
FIG. 5 is a front view of the slide latch body according to the present invention.
Figure 6:
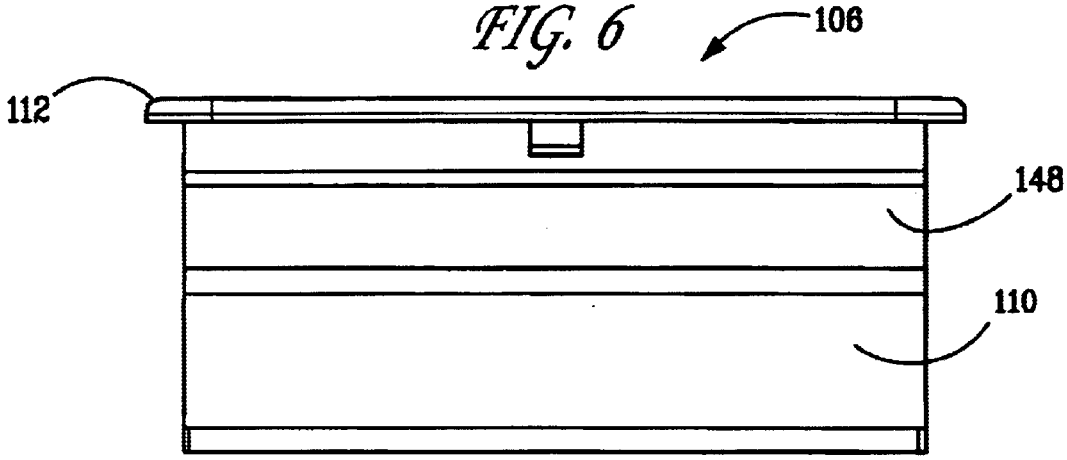
FIG. 6 is a rear view of the slide latch body according to the present invention.
Figure 7:
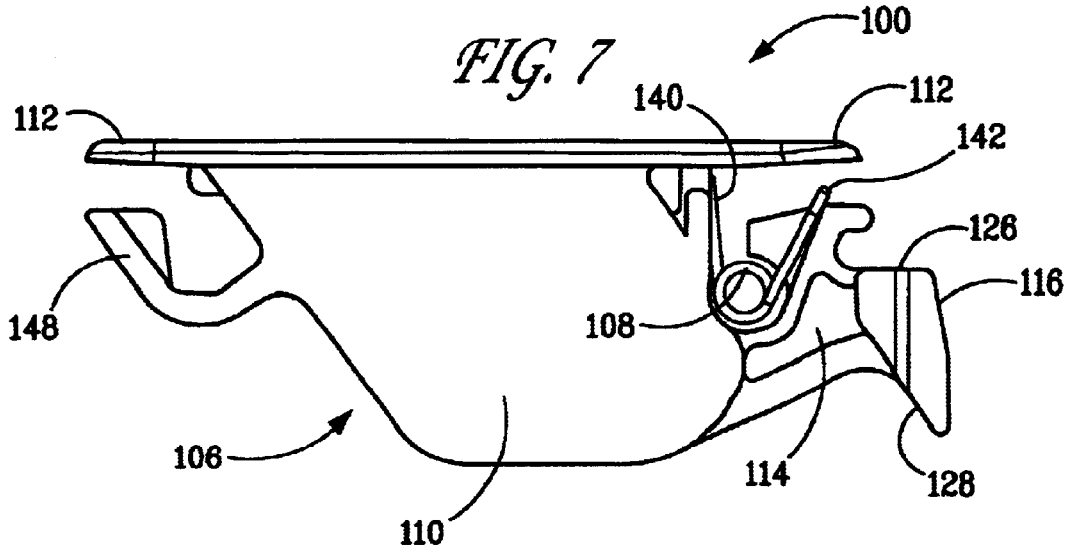
FIG. 7 is a right side elevational view of the slide latch according to the present invention.
Figure 8:
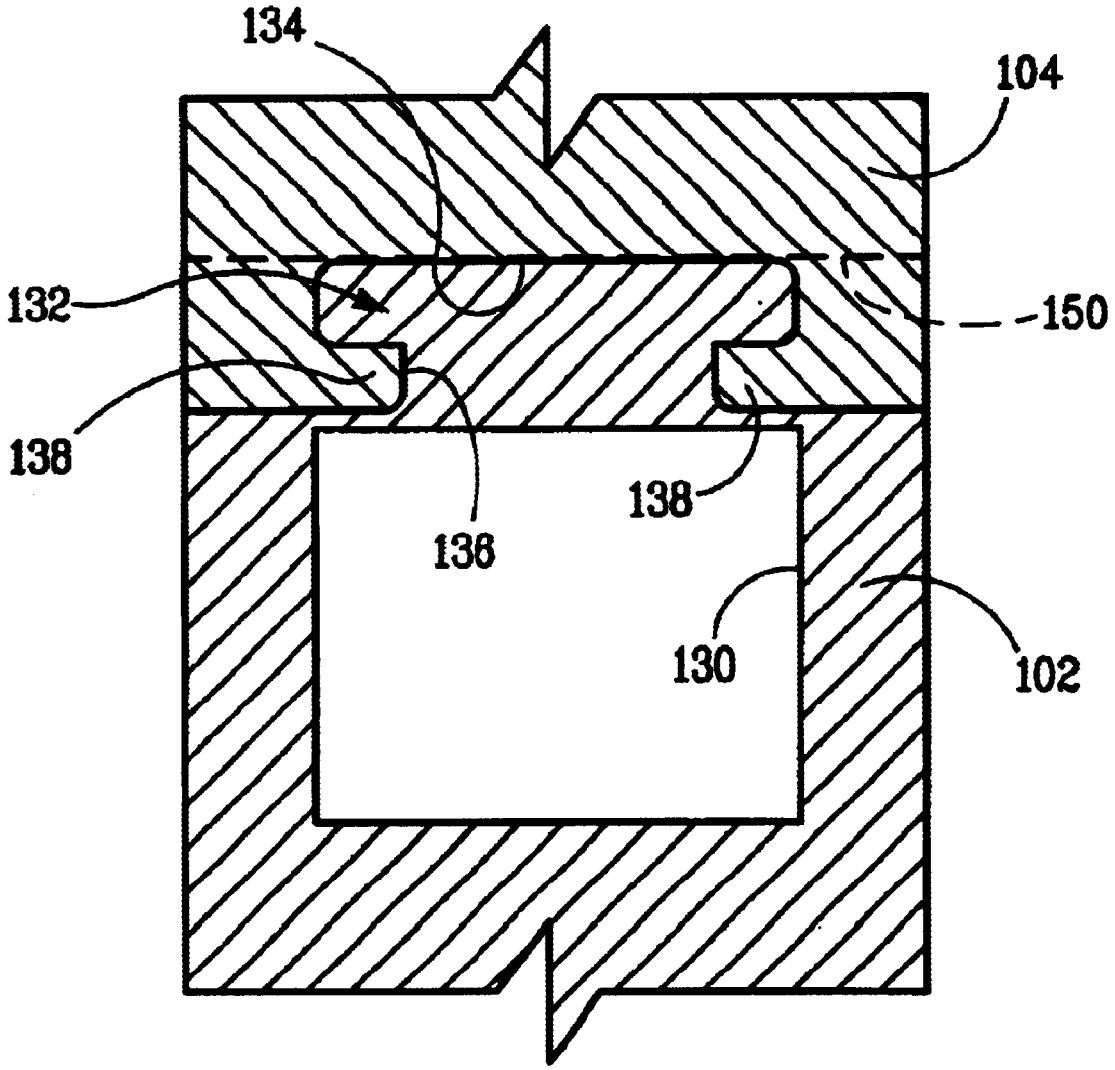
FIG. 8 is a bottom plan view showing the cutouts in the panel and frame designed for use with the slide latch of the present invention.

Referring to FIGS. 1–10, the present invention is directed to a slide latch 100 for use with closure members such as panels, drawers, doors, doorframes etc. The operation of the latch 100 will be described in the context of securing a panel 102 to a frame 104 surrounding an opening covered by the panel 102. In the illustrated example, the latch 100 is shown mounted to the panel 102 and engages the frame 104 to secure the panel 102 in the closed position. However, it is also possible to have the latch 100 mounted to the frame and have the latch engage the panel when the panel is closed.

The slide latch 100 is widely applicable for securing many kinds of doors, windows, panels, and drawers. The latch 100 of the present invention releasably secures a first closure member in closed position relative to a second closure member. The term closure member, as used herein, includes but is not limited to doors, windows, panels, drawers, and the frame surrounding an opening. In the illustrated example, the first closure member is the panel 102 and the second closure member is the frame 104.

The latch assembly 100 of the present invention includes a latch body 106 and a biasing means. In the illustrated example the biasing means is a torsion spring 108. The latch body 106 has a grasping portion 110, a bezel or flange 112, a stem portion 114, and a pawl portion 116. The grasping portion 110 resembles a tub having an open top, four sides and a closed bottom. The grasping portion 110 defines a first cavity 118 that acts as a handle to allow a user to manipulate the latch 100 and to lift the closure member 102 to which the latch 100 is mounted. The first cavity 118 extends obliquely under an over-hanging edge 120. The surface 122 of the cavity 118 located below the over-hanging edge 120, and forming a reentrant angle with the flange 112, provides a grasping surface for the user's fingers. The latch body 106 also has a second cavity 124 which houses the torsion spring 108. The second cavity 124 is cooperatively defined by portions of the grasping portion 110 and the stem portion 114. The stem portion 114 is attached to the front of the grasping portion 110 at a location below the flange 112. The stem portion 114 projects forward from the front side of the grasping portion 110. The pawl portion 116 is attached to the end of the stem portion 114 located distally from the grasping portion 110. The pawl portion 116 has a chisel-shaped profile, being somewhat pointed at the bottom and having a somewhat flattened top surface 126. The underside 128 of the pawl portion forms a ramped or cam surface which interacts with the frame 104 to automatically move the latch body 106 to the unlatched position as the panel 102 is moved to the closed position. The pawl portion 116 is at least in part wider than the stem portion 114. The width as used herein is the dimension in the direction perpendicular to the direction of slidable motion D of the latch body 106 as seen in plan view. The second cavity 124 is located below the flange 112 intermediate the pawl portion 116 and the front of the grasping portion 110.

The latch body 106 is installed in an aperture 130 in the closure member 102 and is adapted for sliding movement within the aperture. The frame 104 has a cutout 132 for use with the latch 100. The cutout 132 has a wide portion 134 and a narrow portion 136. The wide portion 134 is spaced apart from the edge of the frame 104 and the narrow portion 136 is located intermediate the wide portion 134 and the edge of the frame 104. The shape of cutout 132 leaves two projecting tabs 138 at either end of the narrow portion 136. The wide portion 134 is dimensioned to provide clearance for the pawl portion 116, while the narrow portion 136 is dimensioned to provide clearance for the stem portion 114, when the latch body 106 is in the unlatched position relative to the panel 102.

Figure 10:
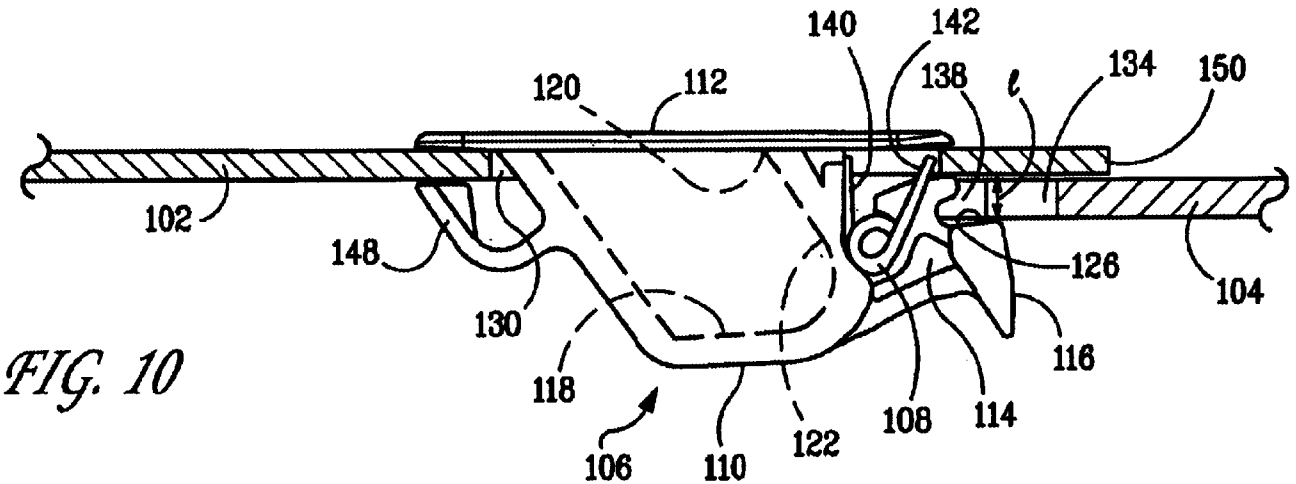
FIG. 10 is an environmental view, with the panel and frame partially broken away, showing the slide latch according to the present invention in the closed or latched position.

The somewhat flattened top surface 126 of the pawl portion 116 catches the underside of the tabs 138 to secure the first closure member 102 to the second closure member 104 when the latch body 106 is in the closed position illustrated in FIG. 10. The torsion spring 108 has a pair of arms 140 and 142, one of which presses against the latch body 106 and one of which presses against a side of the aperture 130 within which the latch body 106 is installed. The torsion spring 108 acts to bias the latch body 106 toward the closed position illustrated in FIG. 10. The beveled surface 128, provided under the pawl portion 116, cooperates with the tabs 138 in a cam-like manner to slide the latch body 106 to the open position as the first closure member 102 is slammed shut. The torsion spring 108 then moves the latch body 106 to the closed position once the top surface 126 of the pawl portion 116 clears the tabs 138 as the panel 102 is moved to the fully closed position. With the panel 102 in the fully closed position, second closure member 104 is in registry with the gap d between the top surface 126 of the pawl portion 116 and the bottom surface of the first closure member 102. Once the tabs 138 are positioned at least in part over the top surface 126 of the pawl portion 116, opening of the panel 102 is prevented until the latch body 106 is moved to the open position by a user.

Figure 9:
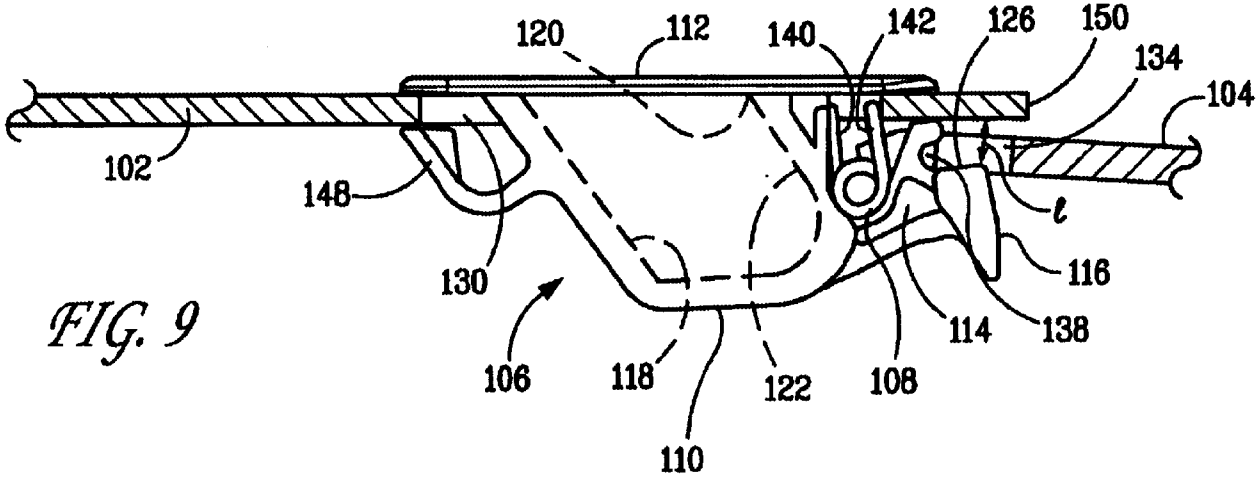
FIG. 9 is an environmental view, with the panel and frame partially broken away, showing the slide latch according to the present invention in the open or unlatched position.

The latch body 106 is moved to the open position illustrated in FIG. 9 by moving the grasping portion 110 toward the location of the engagement between the pawl portion 116 and the frame 104, i.e. by moving the grasping portion 110 toward the tabs 138 and the cutout portions 134 and 136. When the latch body 106 is moved to the open position, the pawl portion 116 and the stem portion 114 are placed in registry with the cutout portions 134 and 136, respectively. Therefore, when pulling on the grasping portion 110 with the latch body 106 in the open position, the panel 102 can be opened without any part of the frame 104 interfering with the latch body 106.

The aperture 130 within which the latch body 106 is fitted should be large enough to allow slidable movement of the latch body away or toward the second closure member 104. But the aperture must be smaller than the flange 112 which preferably completely covers the aperture 130 at all times after the latch 100 is installed in the panel 102 to thereby provide an aesthetically pleasing appearance. To open the latch 100, the user puts at least one finger in the cavity 118 and slides the latch body 106 toward the wide portion 136 of the cutout 132. The panel 102 can then be lifted away from the frame 104 thus allowing the panel 102 to be opened.

The front wall 144 of the cavity 124 has a top edge 146 which is spaced a distance l from the flange 112. The distance l is at least greater than the thickness of the panel 102 so that the spring arm 142 can impinge upon the side of the opening 130 closest to the frame 104 when the panel 102 is in the closed position. As the latch body 106 is moved to ward the wide portion 134 of the cutout 132, the arms 140 and 142 of the torsion spring are brought closer together. Thus the torsion spring 108 tends to push the latch body 106 toward the closed position away from the frame 104.

The torsion spring 108 is placed in the cavity 124 prior to the installation of the latch 100 to the panel 102. To install the latch 100 in the aperture 130, the pawl portion 116 and stem portion 114 are inserted into the aperture 130 from the outer side of the panel 102. During this operation the latch body 106 is held at an angle with the pawl portion 116 being lower than the rest of the latch body 106 such that the pawl portion 116 is the first portion of the latch body 106 to enter the aperture 130. The insertion of portions of the latch body into the opening 130 is continued until the front edge of the flange 112 impinges upon the top surface of the panel 102. The latch body 106 is then pivotally moved about the line of contact between the flange 112 and the outer surface of the panel 102 until the snap leg 148 hits the edge of aperture 130 farthest from the edge 150 of the panel 102. Further application of pressure on the flange 112 causes the resilient snap leg 148 to deform and snap under the panel 102 as the flange 112 is placed flat against the top surface of the panel 102. As the latch body 106 reaches this position, one edge of the opening 130 is positioned between the edge or lip 146 and the flange 112. The spring arm 142 can now impinge upon this edge or side of the opening 130. The flange 112 prevents the latch body 106 from being pushed completely through the opening 130, while the lip 146 and the snap leg 148 prevent the latch body 106 from being pulled out of the aperture 130. The latch body 106 is preferably made in one piece of injection molded plastic.

It is to be understood that the present invention is not limited to the embodiments described above, but encompasses any and all embodiments within the scope of the following claims.

I claim:

1. A slide latch for releasably securing a first member in a closed position relative to a second member, the slide latch comprising:

a latch body adapted for being received in an aperture formed in the first member, said latch body being movable between a closed position and an open position, said latch body having a pawl portion adapted to engage the second member when said latch body is in said closed position, said latch body having a grasping portion; and a biasing means biasing said latch body toward said closed position, said latch body being adapted such that said grasping portion is moved toward a location where said pawl portion engages the second member to move said latch body to said open position, when said latch body is initially in said closed position with said pawl portion engaging the second member.

2. The slide latch according to claim 1, wherein said latch body further includes a stem portion extending between said grasping portion and said pawl portion, said pawl portion being at least in part wider than said stem portion in plan view.

3. The slide latch according to claim 2, wherein said biasing means is located on the same side of said grasping portion as said pawl portion.

4. The slide latch according to claim 3, wherein said pawl portion has a bottom and at least one cam surface intermediate said bottom of said pawl portion and said grasping portion, whereby said cam surface acts to move said latch body to said open position as said cam surface is brought into engagement with the second member.

5. The slide latch according to claim 4, wherein said pawl portion has a substantially a chisel-shaped profile with said bottom being pointed.

6. The slide latch according to claim 5, wherein said latch body has a cavity housing said biasing means, said cavity housing said biasing means being located on the same side of said grasping portion as said pawl portion.

7. The slide latch according to claim 6, wherein said biasing means is a torsion spring having one arm in contact with the latch body and one arm in contact with the first member as said latch body is moved from said closed position to said open position.

8. The slide latch according to claim 7, wherein said grasping portion resembles a tub having an open top, four sides and a closed bottom, said grasping portion defining a first cavity that acts as a handle to allow a user to move said latch body between said open and closed positions.

9. The slide latch according to claim 8, wherein said first cavity extends under an over-hanging edge to provide a grasping surface for the user's fingers.

* * * * *